US010532837B2

(12) United States Patent
Baud et al.

(10) Patent No.: US 10,532,837 B2
(45) Date of Patent: Jan. 14, 2020

(54) METHOD FOR LOADING A 3D FLEXIBLE POUCH TO BE FILLED, SYSTEM FOR LOADING AND STORING THIS FLEXIBLE POUCH AND ASSOCIATED SUPPORT DEVICE

(71) Applicant: SARTORIUS STEDIM FMT SAS, Aubagne (FR)

(72) Inventors: Stephane Baud, La Bouilladisse (FR); Frederic Bernard, La Cadiere d'azur (FR)

(73) Assignee: SARTORIUS STEDIM FMT SAS, Aubagne (FR)

( * ) Notice: Subject to any disclaimer, the term of this patent is extended or adjusted under 35 U.S.C. 154(b) by 526 days.

(21) Appl. No.: 15/116,605

(22) PCT Filed: Feb. 5, 2015

(86) PCT No.: PCT/FR2015/050279
§ 371 (c)(1),
(2) Date: Aug. 4, 2016

(87) PCT Pub. No.: WO2015/118269
PCT Pub. Date: Aug. 13, 2015

(65) Prior Publication Data

US 2016/0347486 A1 Dec. 1, 2016

(30) Foreign Application Priority Data

Feb. 6, 2014 (FR) ..... 14 50906

(51) Int. Cl.
*B65B 3/04* (2006.01)
*A61J 1/10* (2006.01)
(Continued)

(52) U.S. Cl.
CPC ..... *B65B 3/045* (2013.01); *A61J 1/10* (2013.01); *B65B 61/20* (2013.01); *B65B 67/1233* (2013.01)

(58) Field of Classification Search
CPC .. B65D 75/5877; B65D 77/065; B65D 77/06; A61J 1/05; B67D 2001/0827; B65B 3/045; A47B 3/00; A47B 3/0818; F16L 3/127
See application file for complete search history.

(56) References Cited

U.S. PATENT DOCUMENTS 2,588,842 A * 3/1952 Hutt ..... C21C 5/4606 141/388
3,100,587 A * 8/1963 Cox, Jr. ..... B65D 75/5872 222/105
(Continued)

FOREIGN PATENT DOCUMENTS

EP 0 326 730 B1 8/1989
EP 1 012 073 A1 6/2000
(Continued)

OTHER PUBLICATIONS

International Search Report, dated Apr. 13, 2015, from corresponding PCT application.

*Primary Examiner* — Alexander M Valvis
*Assistant Examiner* — Daniel Jeremy Leeds
(74) *Attorney, Agent, or Firm* — Young & Thompson

(57) ABSTRACT

A support device (20), mounted on an upper edge of a container (3), includes lifting elements that define a support surface (22) which extends transversely outwards from an inner edge (55). The upper end (2*b*) of a flexible pouch for biopharmaceutical product can rest on this support surface, the rest of the 3D-type pouch extending into the container. The slot (23) which separates the support surface into two portions defines a guide path for a flexible supply line (9*a*,
(Continued)

9*b*) for the pouch (2) that is connected at its bottom to the end (2*b*). A convex surface is formed at the rear end of the slot and above the edge of the container, so as to guide and facilitate the passage of the line (9*a*) into the housing, when the filling state is sufficiently advanced. The causes of poor deployment of the pouch are thus minimized, without human intervention.

13 Claims, 10 Drawing Sheets

(51) Int. Cl.
*B65B 61/20* (2006.01)
*B65B 67/12* (2006.01)

(56) References Cited

U.S. PATENT DOCUMENTS 3,319,684 A * 5/1967 Calhoun ..... A61J 1/05 190/107
3,361,309 A * 1/1968 Simkins ..... B65D 77/065 222/183
4,973,327 A * 11/1990 Goodrich, Jr. ..... A61J 1/10 383/119
5,988,422 A 11/1999 Vallot
6,076,457 A 6/2000 Vallot
6,186,932 B1 * 2/2001 Vallot ..... A61J 1/05 493/189
6,293,432 B1 * 9/2001 Hartwall ..... B65D 77/061 141/10
6,684,646 B2 * 2/2004 Voute ..... A01N 1/00 62/66
6,814,327 B1 * 11/2004 Myer, II ..... A47L 9/248 137/355.17
6,848,596 B2 * 2/2005 Balz ..... B65D 75/008 222/1
6,945,056 B2 * 9/2005 Brown ..... A01N 1/02 62/356
7,104,074 B2 * 9/2006 Voute ..... A01N 1/00 280/79.3
7,188,744 B2 * 3/2007 Hurst ..... B65B 69/0091 220/9.2
7,284,579 B2 * 10/2007 Elgan ..... B65D 19/08 141/10
7,562,780 B2 * 7/2009 Gilpatrick ..... B08B 3/026 211/70.6
7,740,212 B2 * 6/2010 Austin ..... A61G 7/0503 248/65
7,980,410 B2 * 7/2011 De Muinck ..... B65D 31/10 220/495.06
8,556,107 B2 * 10/2013 McRobbie ..... B65D 75/26 220/495.06
8,627,980 B2 * 1/2014 Woodruff ..... A47K 3/001 220/495.03
9,243,724 B1 * 1/2016 Lake ..... F16L 3/1058
9,266,669 B2 * 2/2016 Barbaroux ..... B01F 7/163
2002/0094923 A1 * 7/2002 Edwards ..... B65D 31/005 493/221
2005/0073908 A1 * 4/2005 Bibbo ..... A61L 2/02 366/314
2006/0023973 A1 * 2/2006 Plunkett ..... B65D 75/5877 383/22
2006/0175385 A1 * 8/2006 McDowell ..... B65D 5/545 229/117.32
2007/0034750 A1 * 2/2007 Pierce ..... F16L 3/1218 248/49
2008/0000922 A1 * 1/2008 Nevils ..... E03B 11/02 220/723
2008/0267538 A1 * 10/2008 Stephenson ..... B65D 25/16 383/33
2009/0223080 A1 * 9/2009 McCarthy ..... A61J 1/10 34/284
2010/0213801 A1 * 8/2010 Ceballos-Godefroy ..... A47B 3/00 312/249.8
2010/0275757 A1 * 11/2010 Hallet ..... A63C 11/025 84/318
2011/0005959 A1 * 1/2011 Van Puijenbroek ..... B65D 75/566 206/524.6
2011/0089194 A1 * 4/2011 Pizzolo ..... B05B 9/0403 222/105
2011/0271646 A1 11/2011 Elgan et al.
2013/0049356 A1 * 2/2013 Pittet ..... A61J 1/1475 285/125.1
2013/0119209 A1 * 5/2013 Radakovic ..... F16L 3/015 248/70
2013/0164731 A1 * 6/2013 Cimino ..... A61M 1/0001 435/1.1
2013/0308881 A1 * 11/2013 Blomberg ..... A61J 1/10 383/42
2014/0319150 A1 * 10/2014 Flank ..... A61J 1/10 220/529
2015/0138913 A1 * 5/2015 Jones ..... B01F 7/001 366/185
2015/0157534 A1 * 6/2015 Van Puijenbroek ..... B65D 75/5877 206/525
2015/0329184 A1 * 11/2015 Deletre ..... B63B 27/24 248/81
2016/0068293 A1 * 3/2016 Cutting ..... A01N 1/0252 53/432
2016/0347486 A1 * 12/2016 Baud ..... B65B 3/045
2018/0250462 A1 * 9/2018 Groder ..... A61M 1/1664

FOREIGN PATENT DOCUMENTS

EP 1 012 227 A1 6/2000
FR 2 781 202 A 1/2000
WO 99/02425 A1 1/1999
WO 00/04131 A1 1/2000

* cited by examiner

METHOD FOR LOADING A 3D FLEXIBLE POUCH TO BE FILLED, SYSTEM FOR LOADING AND STORING THIS FLEXIBLE POUCH AND ASSOCIATED SUPPORT DEVICE

FIELD OF THE INVENTION

The invention relates to the field of biopharmaceutical fluid packaging and, in particular, to the filling of a flexible reservoir in the form of a 3D (three-dimensional) flexible pouch which is to be placed in a rigid container. The invention concerns a method for loading such a flexible pouch when it is to be filled, a system for loading and storing this flexible pouch, and a support and guide device for implementing this loading method.

The term "biopharmaceutical product" is understood to mean a product of biotechnology—culture media, cell cultures, buffer solutions, artificial nutrition liquids, blood products and blood product derivatives—or a pharmaceutical product or more generally a product for use in the medical field. Such a product is in liquid, paste, or possibly powder form. The invention is also applicable to the filling of flexible pouches with other products but subject to similar requirements concerning packaging.

BACKGROUND OF THE INVENTION

A 3D pouch for receiving such a biopharmaceutical product is known, comprising a lower end wall, an upper end wall, and a flexible side wall, which can be in two extreme states—folded flat, and unfolded and deployed—and can be deformed to change from one to the other of these states or may be in any intermediate state. The walls of the pouch, of a plastic material such as polyethylene or a complex comprising polyethylene, define an internal space, which in the folded state is of minimal volume and in the unfolded and deployed state is of maximal volume. This space is intended to receive the biopharmaceutical product for storage, processing, and/or control. Such a flexible pouch, which is biocompatible and disposable, can have a significant volume of at least 50 liters and up to 3,000 liters or more, which justifies calling it "3D". Such a pouch thus provides a significant capacity while being easy to store. An example of such a pouch is described in international patent application WO00/04131 or in patent FR 2781202. When filled with biopharmaceutical product, such a 3D flexible pouch must be placed in a rigid container which supports it externally. This type of rigid container is suitable for storage, possibly with the possibility of stacking. Some rigid containers are also used for transport, while others are more suitable for weighing operations. The use of a rigid container is therefore very widespread for the handling of fluids contained in a 3D flexible pouch. The storage housing of the container is accessible through an upper transverse opening defined by an upper edge, and is possibly accessible through side doors.

In one implementation, such a rigid container comprises a lower transverse wall and an upright axial peripheral side wall delimiting an upper transverse opening for accessing a housing defined by the inner faces of these walls, suitable for receiving the pouch containing the biopharmaceutical fluid which presses against the inner faces. Patent EP-A-1012073 discloses such a container, further provided with a protective containing wall adapted to be placed transversely in the housing of the rigid container, having dimensions such that the transverse clearance between its free outer peripheral edge and the inner face of the facing side wall of the rigid container is limited.

The flexible pouch is conventionally placed in the storage housing of the rigid container in order to begin loading it. Given the significant weight and the volume of the pouch when filled and inflated, the pouch is initially positioned at least in part on the bottom of the housing formed by the lower transverse wall. This pre-positioning eliminates having to manipulate or transport the pouch when in the filled state. The pouch has an upper end at a distance from the bottom of the housing and typically provided with at least one connection port, and preferably at least two ports, used for filling. The upper end comprises, for example, an inlet port or a port for introducing a biopharmaceutical product and a gas supply port. Corresponding supply lines, each connected to a supply source which is typically external to the rigid container, traverse or extend along the upper transverse access opening, for connection to their respective ports. Alternatively, the filling may be done using a lower supply line. Patent EP-B1-0326730 describes a filling of this type, with the disadvantage that the flexible pouch is more complex, as it is provided with side flaps which limits the usefulness of this type of option. It is generally desirable to limit the complexity and cost of the 3D flexible pouch since it is a single-use disposable item.

It is also known, for pouches of very high capacity (for example 1500 L or 3000 l), to use a hoist system as described in patent US20110271646 to equip the rigid container. The 3D flexible pouch that is used is conventional, but it is necessary to preposition the flexible pouch by lifting it vertically using the hoist system. In this case, the filling with biopharmaceutical fluid is performed from below. The use of a hoist system, which requires attachments to the pouch, is relatively restrictive for an operator.

In practice, the unfolding of the flexible pouch during filling requires human supervision, as incorrect deployment related to pouch flexibility and the mobility of the supply lines can occur. The following have been observed without human intervention:

- the flexible pouch catching on the inner faces of the axial wall of the rigid container, resulting in incorrect unfolding and the risk of damage to the disposable flexible pouch,
- incorrect orientation of the flexible pouch within the housing of the rigid container, which reduces the capacity of the flexible pouch,
- interfering blocking position of the connected lines, which causes the flexible pouch to fill incorrectly, preventing it from reaching a nominal fill volume and resulting in the risk of detachment at the ports of the flexible pouch.

SUMMARY OF THE INVENTION

There is therefore a need for a simple, economically viable solution, facilitating deployment of the pouch during its filling and eliminating the need to watch for the pouch catching on the container.

According to a first aspect, the invention relates to a method for loading, in the storage housing of a rigid container, a 3D flexible pouch that can be filled with a biopharmaceutical product by means of at least one flexible supply line.

The loading method comprises, before filling, the steps consisting essentially of:

extending the flexible pouch, in an initial non-filled state, along a given inner face of the storage housing, so as to define a lower end and an upper end which are arranged one on either side of said upper transverse opening, wherein the upper end of the flexible pouch comprises at least one upper port to which said flexible supply line is connected, said upper port being arranged on a given face of the flexible pouch in its initial non-filled state;

maintaining the upper end outside of the storage housing.

More particularly, the loading method comprises the steps consisting essentially of:

providing a support surface on the rigid container, by means of at least one support device mounted along a determined side of the upper edge, orientating and positioning the flexible pouch so that a first portion of the given face of the flexible pouch is face to face with the given inner face and so that a second portion of said given face of the flexible pouch (which is part of the upper end) is in contact with the support surface, such that said flexible supply line connects to the flexible pouch from underneath (relative to the support surface), and before or during filling, inserting said flexible supply line into a slot that separates said support surface into two surface portions, while keeping the second portion of the given face, which is part of the upper end of the flexible pouch, placed against the support surface, during filling, guiding said supply line by a convex guide surface provided in the support device and extending between the two surface portions, the guide surface covering a portion of the upper edge and delimiting one end of the slot, whereby the supply line can be lifted above the upper edge during filling, when the upper end of the flexible pouch is moved into the storage housing.

It is thus possible to control the proper positioning of the upper end of the pouch and the associated flexible supply lines as filling begins and to guide the movement of the flexible supply lines, at least until the upper end has completed its tilt in the storage housing. The use of a slot for positioning the supply lines makes it possible to place these lines closer to the upper edge and to limit their lateral movement. Surprisingly, it has been observed that maintaining the upper end on the support surface and guiding the supply lines in a transverse slot prevents:

the initial retention of fluid in retention areas distanced from the lower end of the pouch; indeed, such maintaining on a support surface (which is mounted on the upper edge) provides a substantially horizontal or downward slope from the upper end to the upper opening of the container, so that when filling begins the flow of fluid is guided toward the inside of the storage housing;

the reduced mobility of the flexible supply lines prevents the pouch from twisting, significantly reducing incorrect unfolding of the pouch;

line blockage, as the convex guide surface eliminates pressing against sharp corners or edges.

In one embodiment, the support surface is placed on the rigid container so as to extend transversely and laterally outwards relative to the given inner face of the storage housing, whereby the upper end of the flexible pouch is in a laterally offset position relative to the storage housing when the upper end is resting on the support surface.

According to one feature, before filling, another flexible line is connected to a lower port located in the lower end of the flexible pouch, and this other flexible line is inserted into a through-hole to pass through the bottom of the storage housing.

According to one feature, the flexible pouch is filled using at least one flexible supply line, and preferably two flexible supply lines, and a corresponding number of upper ports, preferably two upper ports, provided in the upper end of the flexible pouch, on the side of the given face. During filling, at least one flexible supply line is guided by the convex guide surface. Two flexible supply lines may be inserted into the slot which extends, for example, between two coplanar shelves.

In various embodiments of the method, one or more of the following features may possibly be included:

the flexible pouch has a capacity of between 100 and 1000 L, preferably between 200 and 500 L, the storage housing of the rigid container being adapted to contain the entire contents of the flexible pouch in a filled state;

the support device is removably attached to the determined side of the upper edge;

the upper end of the flexible pouch is placed at a height level at least equal to the height level of the determined side of the upper edge, when it is resting on the support surface;

the support surface and the given inner face form planes which are secant, so that the angle formed between said first portion and said second portion is between 60° and 130° prior to filling, preferably between 70° and 110°, and more preferably between about 90° and 100°;

the second portion of said given face is part of the upper end of the flexible pouch, the upper end of the flexible pouch being moved to inside the storage housing in a passive manner under the simple effect of the increase in mass and volume of the assembly formed by the flexible pouch and the biopharmaceutical product contained in the flexible pouch;

the support surface is moved from a folded position that enables attachment of the support device, to a deployed position that enables the support surface to support the upper end of the flexible pouch at a height level that is higher than the upper edge;

the deployed position is locked by the contact of at least one pin that is integral in rotation with the support surface, against a stop of the support device which is integral to a fastening element attached to the rigid container;

the upper end of the flexible pouch extends parallel to the support surface which is substantially planar, prior to filling;

the flexible supply line is initially placed at a distance from the guide surface when the upper end of the flexible pouch is placed on the support surface, the insertion of the flexible supply line into the slot optionally being limited by a spacer member integral to the support device, and the lower end of the flexible pouch is initially maintained at a distance from a distal wall of the container opposite to the given inner face of the container, the unfolding of the flexible pouch along the bottom of the storage housing allowing, as the flexible pouch is filled, the pulling of the upper end of the flexible pouch inwardly into the storage housing, so that said flexible supply line engages with and moves against the guide surface.

According to a second aspect, the invention relates to a system for loading and storing a 3D flexible pouch to be filled with a biopharmaceutical product by at least one flexible supply line located at an upper end of the flexible pouch, for the implementation of the method according to the invention, the system comprising a rigid container having a bottom, a side wall extending longitudinally from the bottom to an upper edge defining an upper transverse opening, so as to define a storage housing for receiving the flexible pouch in a filled state, the storage housing being accessible through the upper transverse opening, this system comprising, on a determined side of the upper edge, a support device which comprises:

- a fastening element on said determined side of the upper edge;
- lifting means which extend between an inner edge adjacent to the upper transverse opening and at least one outer edge, the lifting means defining a support surface extending transversely outwards from the inner edge to said outer edge, the support surface being adapted to maintain the upper end of the flexible pouch to be filled outside of the storage housing;
- a slot which separates said support surface into two surface portions, suitable for the passage of the flexible supply line when the upper end of the pouch is resting on the support surface;
- a convex guide surface which extends between the two surface portions and defines one end of the slot, the guide surface covering a portion of the upper edge.

"Lifting" is understood to mean maintaining the upper end of the flexible pouch at a height level close to that of the upper edge, which allows positioning this upper end in a predominantly horizontal plane. This transverse orientation of the area where the supply lines are connected allows bringing forward the port for connecting the flexible supply line against the guide surface. The lifting prevents the impediments associated with the catching of the flexible supply line, and/or a clamping member that is generally mounted on this flexible line, on the underside of a container lip. For the guide surface, the term "convex" is understood to mean presenting a generally curved appearance and projecting towards the area where the supply line and the pouch connect, whereby the flexible line or lines are maintained face-to-face with the guide surface and between the two surface portions. The convex curvature of the guide surface facilitates movement of the upper end of the flexible pouch to the storage housing, smoothly and without catching.

In one embodiment, the support surface extends at a height level at least equal to the height level of the determined side of the upper edge.

In various embodiments of the system for loading and storing a 3D flexible pouch, one or more of the following features may possibly be included:

- the convex guide surface has a continuous rounded C-shaped cross-section;
- the distance between the inner edge and the outer edge is smaller than the smallest dimension of the storage housing; said distance may be between 10 and 40% of a width of the storage housing;
- to allow detachable attachment of the support device on the determined side of the upper edge, the fastening element comprises at least one clasping element;
- the clasping element or element(s) comprise a positioning member having a U-shaped cross-section forming two parallel arms spaced apart by a distance greater than the thickness of the determined side of the upper edge, and clamping means to lock the positioning member in place;
- the clamping means comprise an elongate element which defines a first support end intended to be in contact with an outer face of the rigid container, and a second end which traverses a given arm among the arms of the positioning member;
- the clamping means comprise a clamping adjustment element that is movable relative to the elongate element and that engages with the second end of the elongate element in order to adjust the relative position of the elongate element with respect to the given arm;
- the slot is located in a central position on the determined side, such that a virtual vertical midplane exists which passes through the slot and through the through-hole.

Furthermore, a support device is provided that is adapted to be combined with a rigid container to form the loading and storing system according to the invention.

This support device comprises:

- a fastening element which extends longitudinally between two ends and has a lower face adapted for attachment to the determined side of the upper edge;
- lifting means which extend between at least one outer edge and an inner edge adjacent to the upper transverse opening in a state where the support device is mounted on the rigid container, the lifting means defining a support surface extending transversely outwards from the inner edge to said outer edge, the support surface forming an upper face of the support device;
- a slot separating said support surface into two surface portions, preferably opening onto the side of the outer edge, the slot defining a passage for the flexible supply line when the upper end of the pouch is resting on the support surface;
- a convex guide surface which extends between the two surface portions and defines one end of the slot, the guide surface being opposite to the inner face of the fastening element and adapted to cover a portion of the upper edge in a state where the support device is mounted on the rigid container, the support surface generally extending in a plane which intersects the guide surface or lies above the guide surface, such that the support surface maintains the upper end of the flexible pouch to be filled outside of the storage housing and preferably at a predefined height level.

In one embodiment, the convex guide surface comprises a rear end portion of the support surface, extending in a longitudinal direction parallel to the fastening element and having a continuous curved C-shaped cross-section, wherein, when the support surface defines a horizontal plane, the lower face of the fastening element defines at least one longitudinal cavity opening vertically onto the side opposite the support surface and opening horizontally via at least one of the ends of the fastening element.

In various embodiments of the support device, one or more of the following arrangements may possibly be used:

- the device has one or more shelves, for example a first shelf for defining all or part of one of the two surface portions of the support surface, and a second shelf for defining all or part of the other of the two surface portions of the support surface;
- the first shelf and the second shelf are coplanar and each have a lateral edge forming a side of the slot, the slot opening to the exterior on the outer edge side;
- a spacer member distinct from the guide surface is provided which extends transversely to the slot between two ends of which one is integral to the first shelf and the other is integral to the second shelf;
- the spacer member is offset frontward relative to the rear end of the slot;

the spacer member defines a front surface oriented toward a front end of the slot and is adjustable in position relative to the lifting means so as to adjust a distance between said front surface and the inner edge of the lifting means;

the support device comprises a hinge on the fastening element, so that the lifting means are movable in rotation, about a longitudinal axis of the fastening element, between a folded position and a deployed position;

at least one locking member is provided for locking the lifting means in the deployed position;

at least one guide slot is formed on the fastening element, about the longitudinal axis, to guide a rotational movement of all or part of the lifting means, said guide slot respectively defining a front stop and a rear stop, the rear stop preventing said rotational movement when the deployed position of the lifting means is reached.

BRIEF DESCRIPTION OF THE DRAWINGS

Other features and advantages of the invention will become apparent from the following description of several embodiments, given as non-limiting examples, with reference to the accompanying drawings in which.

DETAILED DESCRIPTION

Figure 1:
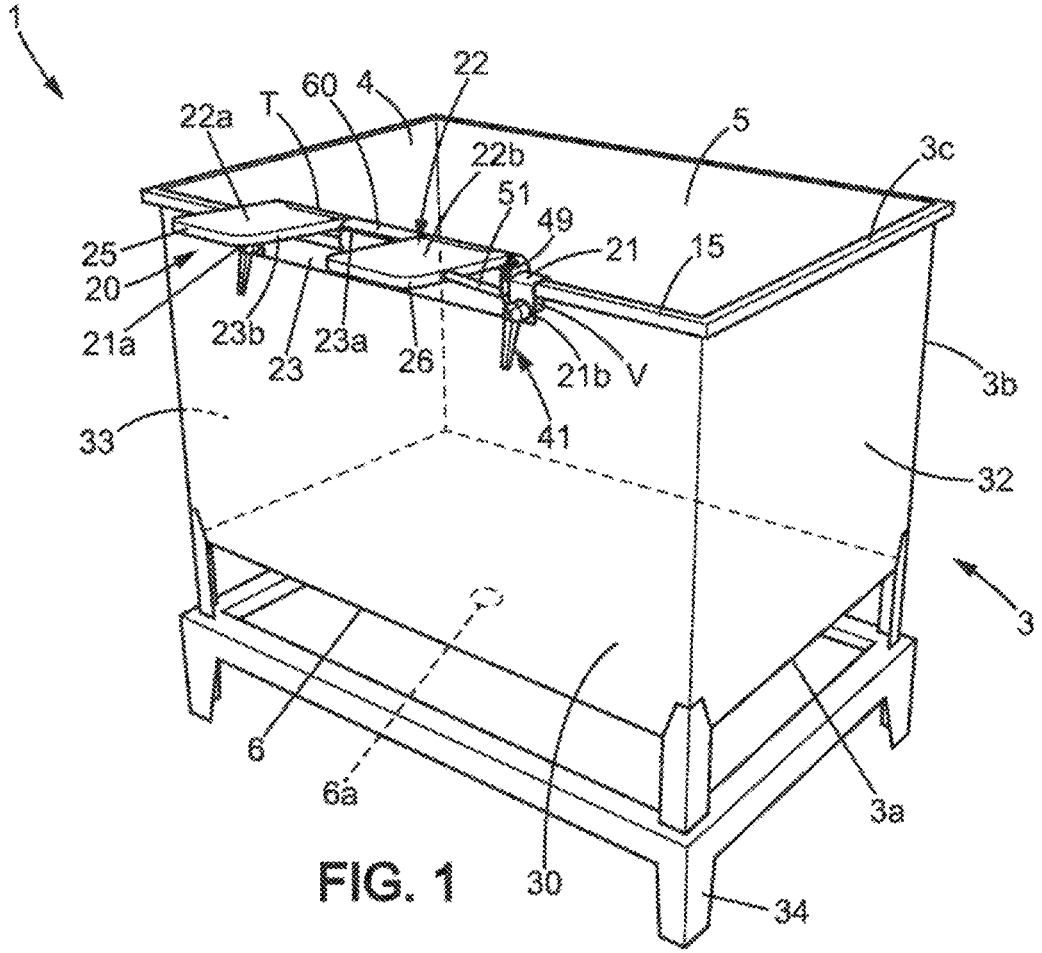
FIG. 1 is a perspective view representing a system for loading and storing in a first embodiment, intended to be loaded with a 3D flexible pouch that is to be filled with biopharmaceutical fluid.
Figure 3:
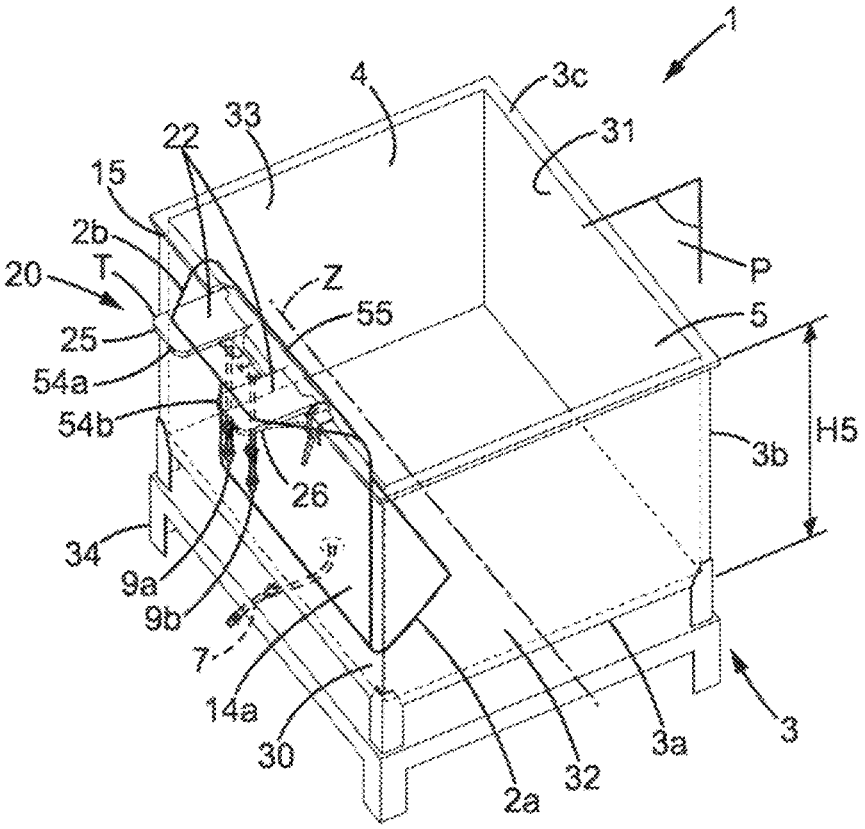
FIG. 3 is a perspective view which illustrates the positioning of the 3D flexible pouch before filling begins, with the upper end of the pouch retained on the support device of the system of FIG. 1.

An exemplary loading and storing system 1 for a 3D flexible pouch 2 is visible in FIGS. 1 and 3. The loading and storing system 1 comprises a rigid container 3 which has a bottom 3*a*, a side wall 3*b* extending longitudinally from the bottom 3*a* to an upper edge 3*c* delimiting an upper transverse opening 4, so as to define a storage housing 5 intended to receive the flexible pouch 2 in a filled state. The storage housing 5 is accessible via the upper transverse opening 4. The bottom 3*a* is here defined by a lower transverse wall 6 and may, where appropriate, include a through-hole 6*a* for an optional flexible line 7 connecting to a lower end 2*a* of the flexible pouch 2. In this case, the through-hole 6*a* may possibly be provided with an adjustable pinch valve (not shown) of a type known per se and adapted to lock the position of the flexible line 7 traversing the bottom 3.

Under normal conditions, the lower transverse wall 6 is arranged horizontally or substantially horizontally while the side wall 3*b* is upright and arranged vertically or substantially vertically, possibly flaring slightly outward from the lower transverse wall 6. The description is provided for this situation.

The words "horizontal", "vertical", "lower", "upper", etc. are understood as being in reference to these conditions. Of course, the rigid container 3 may be placed differently in certain cases, for example for cleaning.

The rigid container 3, of plastic or some other synthetic or metal material, preferably stainless steel, comprises for example an assembly—where appropriate detachable and re-attachable—of a plurality of parts generally in the form of solid or substantially solid panels, flat or substantially flat, as well as parts for connection and/or reinforcement, and any accessories. In the non-limiting example of FIGS. 1 and 3, the side wall 3*b* is formed by a front panel 30, a back panel 31, and two connecting panels 32 and 33 which extend between the front panel 30 and back panel 31. The rigid container 3 may have a stand 34 at the bottom, for example in the form of feet (here four feet) which extend vertically from the corner regions of the transverse wall 6. This stand 34, which extends here below the lower transverse wall 6, allows, among other things, raising the lower transverse wall 6 above the ground and providing access to or allowing connection to ports, fittings, lines, or the like. Such a stand 34 also allows leaving space for the forks of a transport vehicle such as a forklift.

More generally, it is understood that the rigid container 3 can have various configurations, since it is specially adapted for receiving and retaining a 3D flexible pouch 2 specially designed to contain a biopharmaceutical fluid B as defined above. In the embodiment represented in FIG. 6, the rigid container 3 comprises, on its side wall 3*b* or on one or more of its component panels, one or more doors 30*b*, 30*c* or one or more openings allowing access to the interior of the storage housing 5. Where appropriate, such openings or accesses are located so as to correspond to ports, openings, hoses and lines provided on the pouch 2 or associated with it. It is possible to have similar access provided in a lid (not shown).

In FIG. 3, the flexible pouch 2 is partially inserted into the housing 5 before the filling process begins. The flexible pouch 2 is placed along a given inner face 8 of the storage housing 5, so that the lower end 2*a* is folded and lies substantially flat against the bottom 3, while the upper end 2*b* of the flexible pouch 2 extends beyond the upper transverse opening 4, to outside the storage housing 5. Thus the flexible line or lines 9*a*, 9*b* which are connected to the upper end 2*b* of the flexible pouch 2 are initially maintained outside the storage housing 5. The through-hole 6*a* is preferably at a distance from the inner face 8 here formed by the front panel 30 and can allow, by cooperating with flexible line 7, centering the flexible pouch 2 relative to the bottom 3*a* of the rigid container 3. One will note that the ends 2*a* and 2*b* of the flexible pouch 2 do not extend along the inner face 8 but extend transversely to it.

Figure 4A:
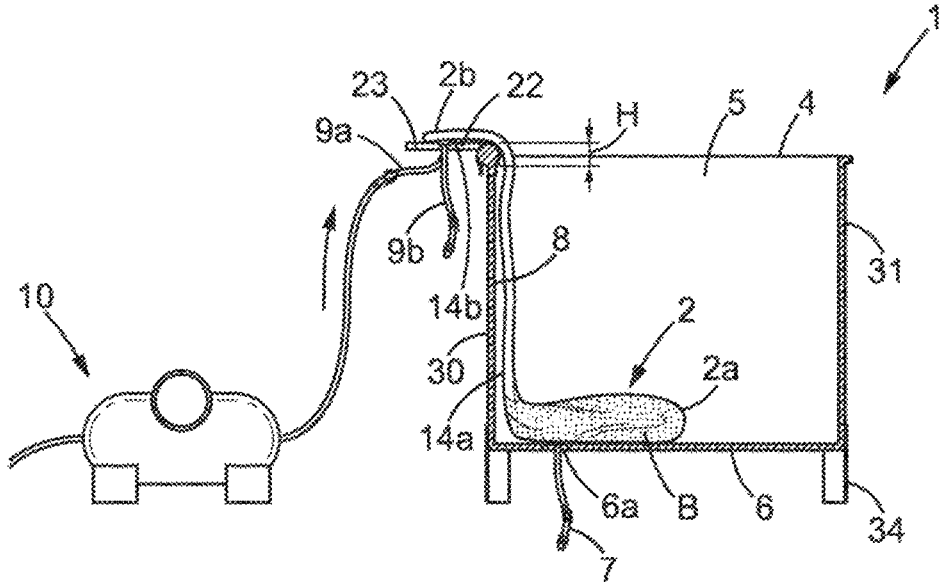
FIGS. 4A and 4B are sectional views illustrating the positioning of the 3D flexible pouch as it is filled and showing the connection between a pumping device and a flexible supply line which is connected to a port at the upper end of the 3D flexible pouch.

As is clearly visible in FIG. 4A, the external positioning of flexible lines 9*a*, 9*b* facilitates connection to a pumping device 10 which is itself connected to or incorporates a source of biopharmaceutical fluid B. In the following description, a line connected to the upper end 2*b* is referred to as a flexible supply line. Furthermore, each of flexible lines 7 and 9*a*-9*b* is preferably equipped with a clamping member such as clamp C1, C2, C3. "Along" the given inner face 8 is understood to mean that the flexible pouch 2 is positioned against or possibly at a small distance from the inner face 8, with no element or accessory inserted between the main part of the flexible pouch 2 (this part being complementary to ends 2*a* and 2*b*) and the inner face 8. This therefore means placing the flexible pouch 2 completely away from the opposite inner face formed by panel 31, preferably with at least one contact with the lower and/or upper side of this inner face 8.

The given inner face 8 may be planar and substantially vertical, particularly when the flexible pouch 2 forms a parallelepiped in the filled state. The bottom of the pouch 2, formed by the bottom wall W1, is in this case is in contact with the transverse wall 6 as illustrated in FIG. 4A. Here, the dimensions of the bottom wall W1 (except for the thickness) can be considered to be identical or substantially equal to those of the bottom 3*a* of the storage housing 5.

Figure 2A:
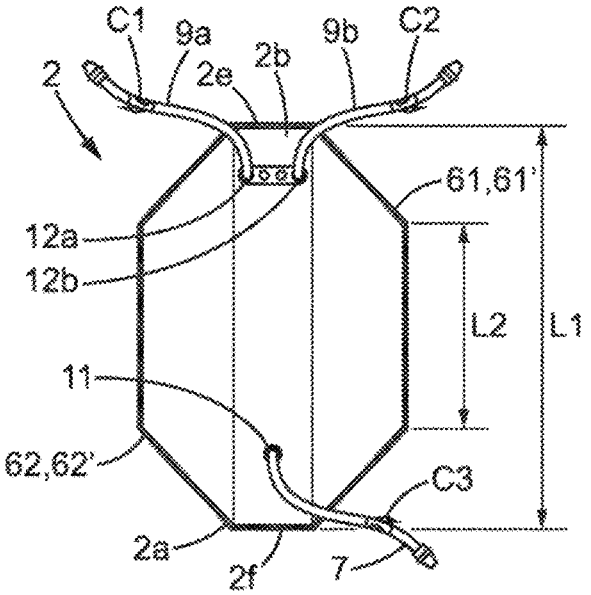
FIG. 2A is a bottom view of a 3D flexible pouch intended to be housed in the rigid container of the system of FIG. 1.

Referring to FIG. 3, the housing 5 may have a depth H5 substantially corresponding to the length of the longest side L2 of the hexagonal shape of the flexible pouch 2 (shape clearly visible in FIG. 2A where the flexible pouch 2 is in a non-filled state). The rigid container 3 has a parallelepiped shape with a length L and a width L3 (therefore L≥L3). The depth H5 is preferably greater than the width L3 and may also be greater than the length L. The housing 5, which is deeper than it is wide, enables the flexible pouch 2 containing the biopharmaceutical fluid B, when filled as shown in FIG. 2C, to press against each of the inner faces of the rigid container 3 of parallelepiped shape. It is understood that the length L1 of the flexible pouch 2 in its initial state before filling, when measured from the lower end 2*a* to the upper end 2*b*, is greater than the depth H5 and greater than the height of the flexible pouch 2 in its deployed and filled state (this height being substantially equal to length L2).

Alternatively, the dimensions H5, L, and L3 may be similar, so that the housing 5 has a general shape similar to a cube or substantially similar to a cube.

These lengths may be, depending on the case, between about 400 cm and 1200 cm, such that the internal volume of the housing 5 may be about 50 liters or 100 liters, but may also reach 1000 liters, these data being exemplary but not limiting. Thus the depth H5 may vary between 520 cm and 1000 cm for typical embodiments. A capacity of between 200 and 500 L may be preferred.

Depending on the dimensions, the lower transverse wall 6 and/or the side wall 3*b* may have external reinforcing ribs.

Of course, the dimensions of the rigid container 3 and those of the 3D flexible pouch 2 are adapted to one another, so that the housing 5 is able to receive the flexible pouch 2. The 3D flexible pouch 2 will be now described with reference to FIGS. 2A, 2B, and 2C. Such a pouch 2 comprises a bottom wall W1, a top wall W2, and a flexible side wall which may be in two extreme states—folded flat, or unfolded and deployed—and be reshaped to change from one to the other of these states or be in any intermediate state. When the flexible pouch 2 is filled with biopharmaceutical fluid B, it is inflated to a greater or lesser degree. While its bottom wall W1 can rest on the inner face of wall 6 of the rigid container 3, its side wall presses against the inner face of the side wall 3*b* of the rigid container 3.

The flexible pouch 2 has one or more inlet or filling or supply openings, in particular in the form of ports 12*a*-12*b* (called upper ports in the following), in particular in the top wall W2, and one or more outlet or discharge or evacuation openings, in particular in the bottom wall W1, in particular in the form of ports 11. The rigid container 3 is arranged to provide access to these openings, for example through the through-hole 6*a*.

The inlet openings are adapted to be closed when necessary and/or a clamp member C1-C2 is used to close off access to the interior of the flexible pouch 2. Similarly, the outlet opening or openings are adapted to be open when necessary and/or a clamp member C3 is used to allow passage through the flexible line 7.

As illustrated in FIG. 2A, the 2D flexible pouch in the folded state has two opposing flat faces, with ports 11 and 12*a*-12 being provided on one of these faces 14. The two other faces (visible in 2C) are folded. The pouch portions forming these two other faces have the shape of flattened bellows and are inserted between the two opposing faces. The flat state of the flexible pouch 2, as obtained immediately after manufacture, is allowed by the superposition of weld seams 61, 61' and 62, 62'.

As can be seen in FIG. 2C, the four longitudinal weld seams 61, 61', 62, and 62' formed between two walls forming adjacent faces are created by three thermal type welds, and K-shaped welds are formed as described in patent EP 1012227 B1.

Referring to FIG. 1, after filling, a removable cover provided with gripping and handling members (not shown) may be placed, along its annular edge, on the free upper edge 3*c* of the rigid container 3. Where appropriate, means for quickly locking such a cover in the closed position are provided. The upper opening 4 is then covered.

Figure 2B:
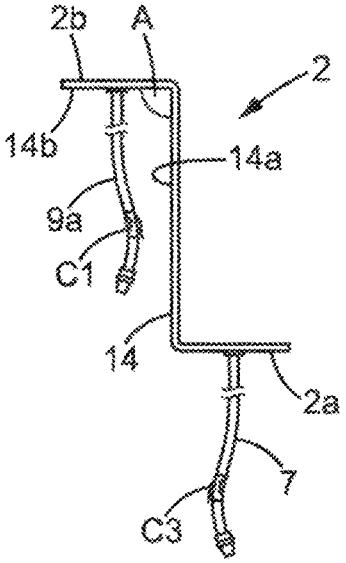
FIG. 2B is a side view of the flexible pouch of FIG. 2A, in a configuration with two parallel fold lines.
Figure 2C:
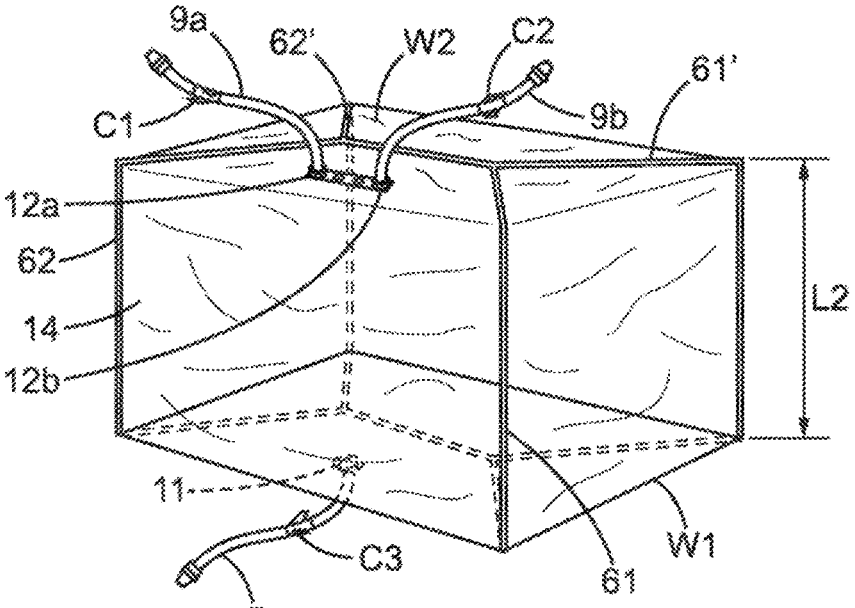
FIG. 2C is a perspective view of a 3D flexible pouch in the deployed state and filled with a biopharmaceutical fluid.

In FIGS. 2A-2C, one can see that the respective ports 11, 12*a*-12*b* for connecting flexible lines 7 and 9*a*-9*b* are provided on the same given face 14 of the flexible pouch 2. As a result, as illustrated in FIGS. 3 and 4A, it is understood that the flexible pouch 2 is positioned on the loading and storing system 1 such that:

- the lower end 2*a* of the flexible pouch 2 lies against the bottom 3 on the side that is the given face 14 of the flexible pouch 2;
- a first portion 14*a* of the given face 14 is face-to-face with the given inner face 8 of the rigid container 3; and
- the upper end 2*b* of the flexible pouch 2 is folded over a determined side 15 of the upper edge 3*c*, and flexible supply line 9*a* connects to the flexible pouch 2 from below at a second portion 14*b* of the given face 14.

Referring to FIGS. 1 and 3-4A, the loading and storing system 1 comprises, on the determined side 15 of the upper edge 3*c*, a support device 20 which extends this determined side 15 radially outward. The support device 20 comprises at least one fastening element 21 for anchoring to the rigid container 3, this fastening element 21 sitting on the determined side 15 in the attached state. Although in the example shown in FIG. 1, the fastening element 21 is one piece, it is understood that the anchoring may be accomplished by at least two anchors attached to two distinct areas of the determined side 15. It is also possible to form the fastening element 21 with two parts which may or may not be identical, possibly telescoping. In the embodiment of FIG. 1, the fastening element 21 extends longitudinally between two ends 21*a*, 21*b* and has a lower face adapted for attachment to said determined side 15 of the upper edge 3*c*. This lower face is preferably generally concave.

The rigid container 3 typically forms a parallelepiped and, more generally, may have a front panel 30 which extends in a vertical or substantially vertical plane and a determined side 15 of the upper edge 3*c*, located on the side of the front panel 30, which is substantially horizontal. The support device 20 may advantageously be attached only on this determined side 15, preferably at a distance from the corners of the container 3.

Figure 6:
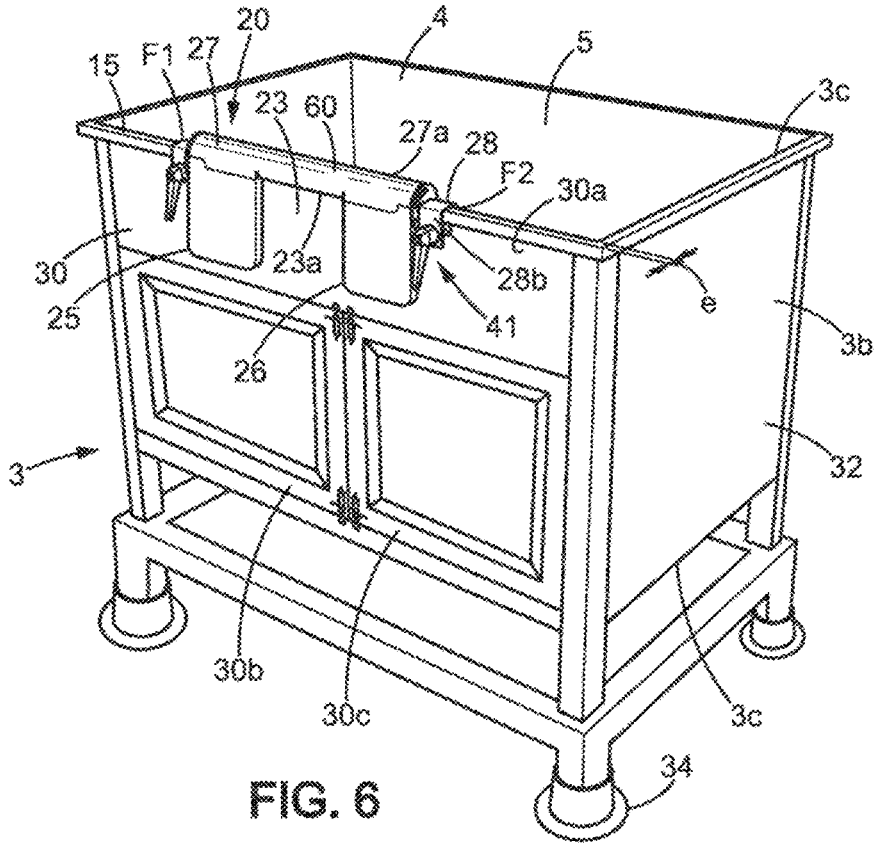
FIG. 6 is a view similar to that of FIG. 1, but with a different rigid container and with the support device in a folded configuration.
Figure 7:
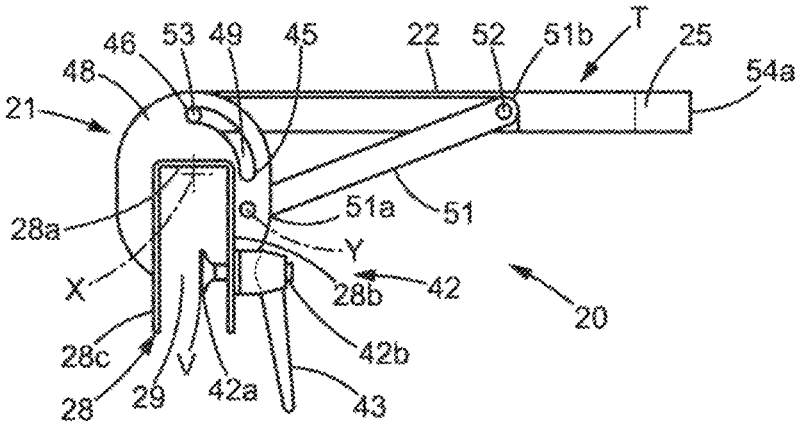
FIG. 7 is a side view showing a support device according to the invention, with the lifting means in a deployed and functional configuration.

Referring to FIGS. 1 and 6-7, lifting means T are mounted on the fastening element 21, preferably hinged about an axis X parallel to the determined side 15 in the assembly configuration. These lifting means T define a support surface 22 serving to hold the upper end 2*b* of the flexible pouch 2 outside of the storage housing 5, preferably at a height level at least equal to the height level of the determined side 15 when it is resting on the support surface 22, as can clearly be seen in FIGS. 3 and 4A. The lifting means T are provided with a slot 23 which separates the support surface 22 into two surface portions 22*a*, 22*b*. Before or during filling, the flexible supply line 9*a* and possibly one or more other adjacent flexible lines 9*b* are inserted into this slot 23, while keeping a second portion 14*b* of the given face 14, which is part of the upper end 2*b* of the flexible pouch 2, placed against the support surface 22.

Figure 5A:
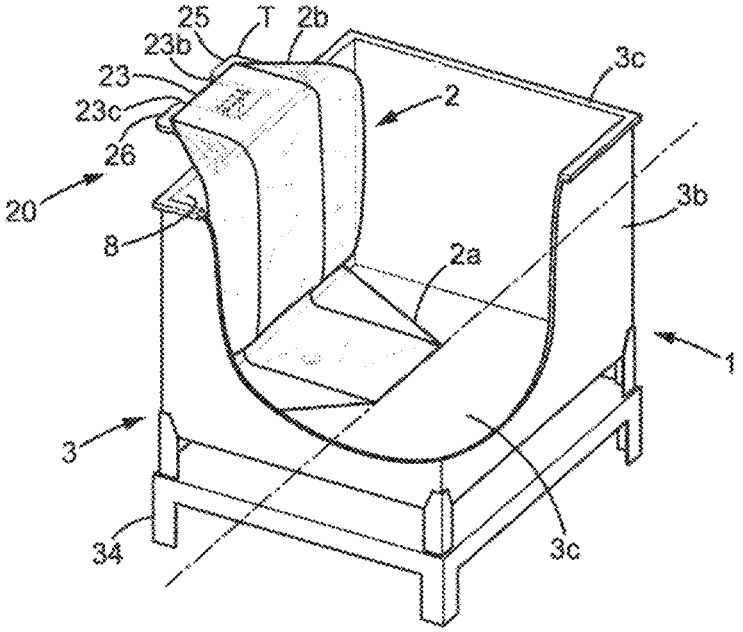
FIGS. 5A-5D each respectively illustrate a filling state of the 3D flexible pouch held by the support device, at different stages of the filling process.
Figure 5B:
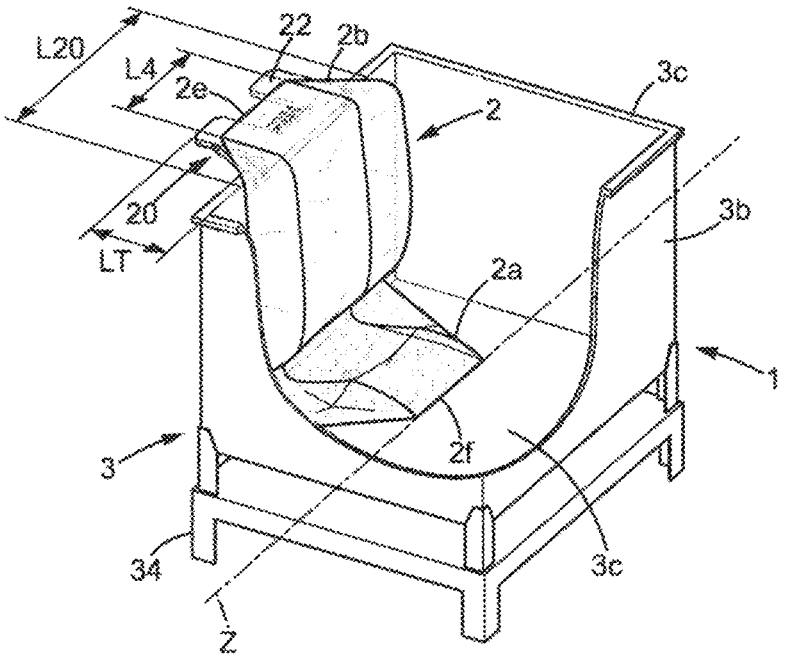
Figure 5C:
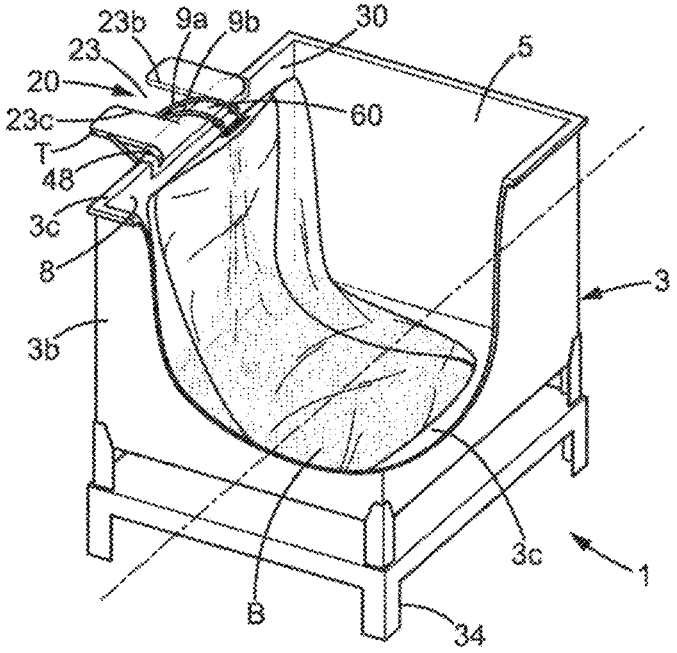
Figure 5D:
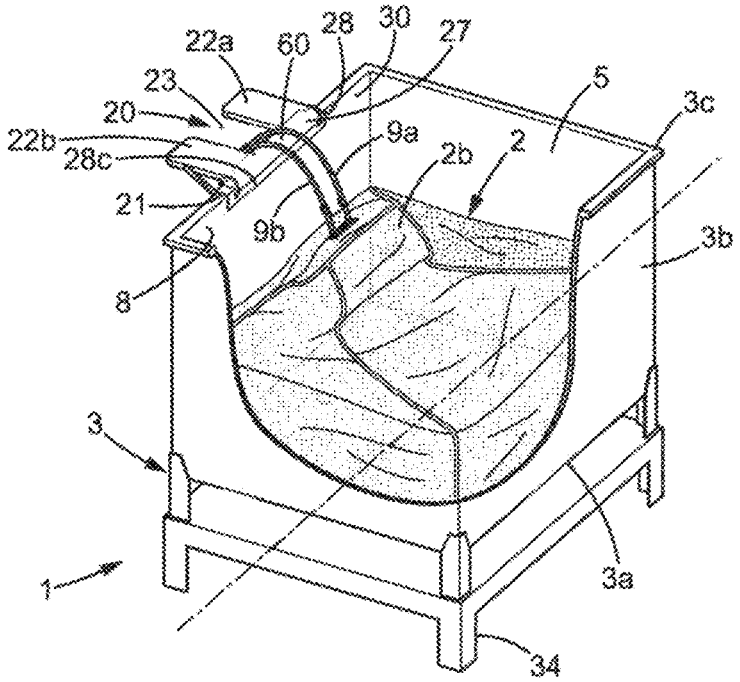

The lifting means T comprise, in this non-limiting example, a first shelf 25 and a second shelf 26 respectively defining a first surface portion 22*a* and a second surface portion 22*b* of the support surface 22. The first shelf 25 and the second shelf 26 are coplanar here and may possibly be connected to one another by an elongate portion 27 which is rotatable relative to the fastening element 21. As is clearly visible in FIG. 6, the elongate portion 27 extends parallel to the X axis and rotates around it to reach a folded configuration of the support device 20, in a position where it is folded towards the front panel 30. The elongate portion 27 may be integral with the shelves 25, 26, or may form a (radially inward) extension which is part of the lifting means T. Here, the elongate portion 27 defines a length L20 of the support device 20 which is, for example, greater than or about half the length of the determined side 15. The inner edge 27*a* of the elongate portion is, for example, located below the edge 3*c* in the folded position and above the edge 3*c* in a deployed position of the lifting means T. Of course, the length of the support device 20 can be adapted to requirements but it is preferable that the length L20 of the support device 20 be at least equal to the length L4 of the edge 2*e* defined at the upper end 2*b* of the 3D flexible pouch 2, as shown in FIG. 5B. The elongate portion 27 has an inner edge which may be straight and parallel to side 15. It is understood that in the deployed position, the support surface 22 extends, from the elongate portion 27, laterally outwards with respect to the given inner face 8, as can be seen in FIGS. 5C-5D.

In the radial direction, the length LT of the lifting means T may be greater than or equal to (L1−L2)/2, which allows supporting the entire upper end 2*b* of trapezoidal shape (see FIGS. 2A, 3, and 5A-5B). One will note that the upper ports 12*a*, 12*b* of the flexible pouch 2 are, for example, placed near the free edge 2*e* (straight in this case) formed at the upper end 2*b*, at a radial distance that is less than length LT.

Of course, other shapes and dimensions may be used for the lifting means T and/or for the flexible pouch 2, according to requirements. Furthermore, it is understood that the distance between the inner edge and the outer edge, defining length LT, may be less than the depth H5 of the storage housing 5, length LT preferably representing between 10 and 40% of depth H5. The support device 20 can thus be relatively compact and more simple to position.

As illustrated in FIG. 7, the fastening element 21 may comprise at least one positioning member 28, for example in the form of one or more U-section or J-section bars, possibly extending for a length identical or similar to that of the elongate portion 27. The positioning member 28 has an intermediate section 28*a*, horizontal here, which rests on the upper edge 3*c* in the assembly configuration. The bar or bars of the positioning member 28 also comprise for example a front arm 28*b* and a rear arm 28*c* extending from the intermediate section 28*a* and defining a cavity 29. The rigid container 3 may possibly have a flange, forming the determined side 15 of the upper edge 3*c*, which can be inserted into the cavity 29. Of course, one or more notches may be provided in the front arm 28*b* or in the rear arm 28*c*.

More generally, it is understood that an upper portion of the rigid container 3, which forms part of the frame surrounding the opening 4, can form a bearing area with preferably three faces each facing one of the inner faces of the positioning member 28. The bearing area, which fills the cavity 29, comprises a front surface portion which may be formed by the upper end 30*a* of the front panel 30.

The front arm 28*b* and rear arm 28*c* extend on both sides of the upper edge 3*c* in the assembly configuration and allow maintaining the support device 20 on the upper edge 3*c*. These front 28*b* and rear arms 28*c* are parallel for example, as can be seen in FIG. 7. For optimum support, the positioning member 28 may have a U-shaped cross-section and the two arms 28*b*-28*c* are separated by a distance greater than the thickness e of the determined side 15 of the upper edge 3*c*. Of course, a plurality of cavities 29 may be defined by the arms 28*b*-28*c* (or tabs) and the intermediate section 28*a*, for example to form several clasping attachment areas F1, F2 on an upper portion of the rigid container 3. This is the case, for example, for the support device 20 shown in FIG. 6.

When the support surface 22 defines a horizontal or substantially horizontal plane, the cavity 29 (longitudinal here) defined by the lower face of the fastening element 21 opens vertically onto the side opposite the support surface 22 and opens horizontally at at least one of the ends 21*a* and 21*b* of the fastening element 21.

Referring to FIGS. 1 and 7, the locking of the fastening element 21 on the upper edge 3*c* can be carried out by clamping means 41 that lock the positioning member 28 in position. In the embodiment of FIG. 7, one can see that the positioning member 28 and the clamping means 41 form at least one clasping element that allows detachable attachment of the support device 20. By way of non-limiting example, the clamping means 41 comprise an elongate element 42, here a rod provided with a suction cup V which defines a first support end 42*a*. The first support end 42*a* can be moved to come into contact with an outer face of the rigid container 3, for example the outer face of the front panel 30. A second end 42*b* of the elongate element 42 has or supports a clamping adjustment element 43. A nut or similar member thus advances the elongate element 42, and a rotatable handle or similar gripping member may be part of element 43 to facilitate locking and unlocking the clamping means 41.

The clamping adjustment element 43 can be used, for example, in the folded configuration of the lifting means T (as in FIG. 6) in order to adjust the clamping force on the upper end 30*a* of the front panel 30 or similar surface of the bearing area. The clamping adjustment element 43 is preferably movable relative to the elongate element 42 and engages with the second end 42*b* of the elongate element 42. The clamping adjustment element 43 has, for example, a tubular portion providing an internal thread that cooperates with a threaded portion of the elongate element 42. More generally, it is understood that the clamping adjustment element 43 is mounted so that it engages with the second end 42*b* in order to adjust the relative position of the elongate element 42 relative to one of the arms 28*b*-28*c*, here the front arm 28*b* of the positioning member 28.

As illustrated in FIGS. 6-7 in particular, the clamping adjustment element 43 may engage the given arm 28*b*, directly or indirectly. This locks the element 43 in translation. It is understood that by extending the portion of the elongate element 42 which is located in the cavity 29, the clamping force against the part of the rigid container 3 which is inserted in this same cavity 29 is increased and the support device 20 cannot be disengaged accidentally. The position of the positioning member 28 is locked. To remove the support device 20, one simply manipulates the clamping means 41 by actuating the adjustment element 43, for example with a rotational movement in the example illustrated, so as to move the elongate element 42 rearwards and thus reduce the length of the portion of the elongate element 42 which is located in the cavity 29.

One advantage of using a fastening element 21 which clamps to engage is that this facilitates adjusting the position of the support device 20 on the determined side 15 of the upper edge 3*c*. It is possible to slide the clasping element or elements 28 41 on the upper edge 3*c*, for example to center the slot 23. It is preferable that the slot 23 be located in a central position on the determined side 15, such that there is a virtual vertical midplane P passing through the slot 23 and possibly through the through-hole 6*a*, as shown in FIG. 3.

When the support device 20 has lifting means T hinged about an axis X, locking in the deployed operating position (position shown in FIGS. 1, 3, 4A-4B, 5A-5D, and 7) can be achieved by contact against a stop 46 which is integral with the fastening element 21 attached to the rigid container 3. Bearings 48 may be provided in the fastening element 21 to permit rotation of the rotationally movable lifting means T about axis X which defines a longitudinal axis of the fastening element 21.

Referring to FIG. 7, the bearing 48 has a guide slot 49 that extends around the longitudinal axis X, to guide the rotational movement of all or part of the lifting means T. This guide slot 49 respectively defines a rear stop or abutment 46 and a front stop 45 located lower than stop 46 in the mounted configuration of the support device 20 and more forward relative to the front arm 28*b*. Stop 46 stops rotational movement when the deployed position of the lifting means T is reached, while front stop 45 defines the end of travel corresponding to the folded position of the lifting means T. In this non-limiting example, one or a plurality of hinged locking members 51 in the form of a connecting pin or the like, connect the lifting means T to the fastening element 21 in order to lock and maintain the lifting means T in the deployed position. Thus, in this deployed position, the support surface 22 can extend and be maintained at a height level at least equal to the height level of the determined side 15 of the upper edge 3*c*.

The hinged locking member 51 has, in the embodiments of FIGS. 1 and 7, a connecting end 51*a* for connecting to the fastening element 51. This connecting end 51*a* pivots about a secondary axis Y located lower than the longitudinal axis and lower or substantially at the same level as the front stop 45. The hinged locking member 51 has another end 51*b* connected to a pivot 52 formed laterally on one of the shelves 25, 26 or similar part of the lifting means T. The position of the pivot 52 and the dimensions of the guide slot 49 are adapted so that each of the shelves 25 and 26 extends in a coplanar and substantially horizontal manner in the deployed position. The support surface 22 here allows, in this deployed position, supporting the upper end 2*b* of the flexible pouch 2 at a higher height level than the upper edge 3*c*.

Figure 10:
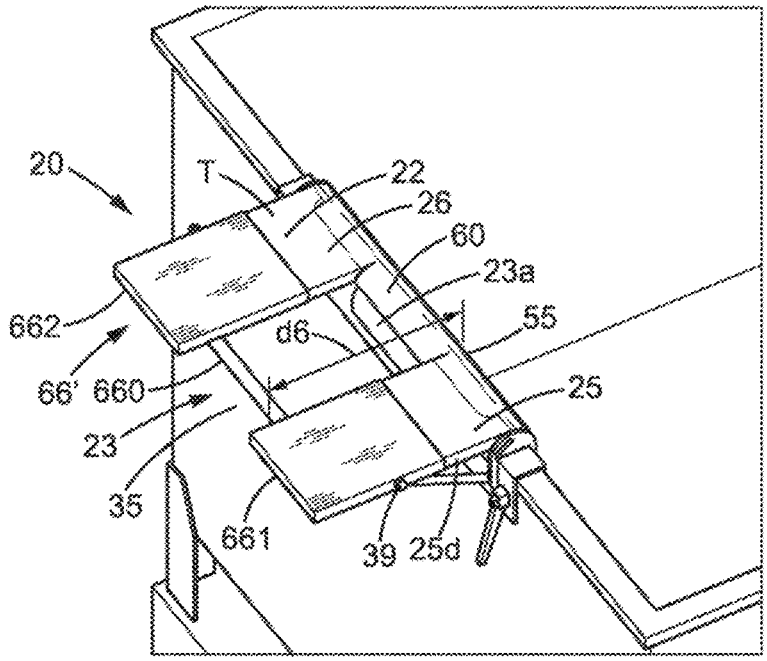
FIG. 10 illustrates another variant of the support device, provided with a spacer member.

Of course, it is possible to obtain the hinge of the lifting means T with other types of mechanism for locking the deployed position. In the example of FIG. 10, the hinged locking member 51 is eliminated and another form of locking is used, for example a wedge which is inserted beneath the lifting means T once the deployed position is obtained.

The lifting means T have at least one insertion member such as a pin 53 for engagement with stop 46 in the extended position. Two pins 53 protruding in a direction parallel to axis X, in opposite directions, may be formed for example on either side of the lifting means T in order to engage respectively with one and the other of the ends 21*a* and 21*b* of the fastening element 21. In FIG. 7, the projecting pin 53 or similar insertion member extends outwardly from a side portion of shelf 25 and moves in the guide slot 49 between stops 45 and 46.

Of course, the lifting means T may be designed without any hinge, and in this case the bearings 28 and mobile connection elements can be eliminated. The lifting means T define a support surface 22 which extends transversely to the front panel 30 of the rigid container 3. More generally, it is understood that the lifting means T extend between at least one outer edge (at a distance from the opening 4) and an inner edge 55 adjacent to the upper opening 4 when the support device 20 is in the mounted state on the rigid container 3. The support surface 22 extends transversely outwards from the inner edge 55 to the outer edge, forming an upper face of the support device 20. The slot 23 opens for example to the exterior on the outer edge side which can be divided into two discrete outer edge portions 54*a* and 54*b*.

Preferably, the lifting means T extend radially for a distance LT at least equal to half the width of the slot 23. The slot width is also typically less than one third of the length of the determined side 15. This arrangement makes it possible to obtain a support surface 22 large enough in both directions to maintain a flat configuration of the upper end 2*b* of the flexible pouch 2, while the slot 23 is dimensioned to effectively guide the flexible supply lines 9*a*, 9*b*, for example between two lateral edges 23*b* and 23*c* formed by the shelves 25 and 26. This guidance can be seen in particular in FIGS. 5A to 5D.

The slot 23 here is wide enough to allow the passage of at least two flexible supply lines 9*a*, 9*b* connected to respective upper ports 12*a* and 12*b* of the flexible pouch 2, when the upper end 2*b* is resting on the support surface 22. The slot 23 passes vertically through the lifting means T, so that the flexible supply lines 9*a*, 9*b* run below the lifting means T and next to the front panel 30 by traversing the slot 23 between the inner edge 55 and the outer edge 54*a*, 54*b*.

Referring to FIGS. 1, 5C-5D, and 6, the support device 20 comprises, on the side of the inner edge 55, a convex guide surface 60 which extends between the two surface portions 22*a* and 22*b* and defines an end 23*a* of the slot 23. The guide surface 60 is opposite to the inner face of the fastening element 21 and may, for example, be defined by all or part of an upper face of the elongate portion 27. This guide surface 60 lies above the level of the upper opening 4, covering a portion of the upper edge 3*c* on the determined side 15, in the mounted state of the support device 20. The support surface 22 extends generally in a plane which intersects the guide surface 60 or lies above the guide surface 60. In other words, the support surface 22 maintains the upper end 2*b* of the flexible pouch 2 to be filled outside the storage housing 5 and at a predefined height level which is at least equal to the level of the guide surface 60. The inner edge 55 of the lifting means T may be defined by the side of the guide surface 60 opposite to the slot 23.

FIG. 2B and FIG. 3 show that the 3D flexible pouch 2 may initially be folded against the inner edge 55 of the lifting means T, with the support device 20 mounted on the container 3 and in the extended position. The upper end 2*b* of the flexible pouch 2 then lies parallel to the support surface 22 which is substantially planar prior to filling. An angle A can thus be formed, in the area in contact with the guide surface 60, between the first portion 14*a* and second portion 14*b* of the given face 14 of the flexible pouch 2. This angle A is, for example, between 60° and 130°, and preferably between 70 and 110°. An angle of about 90° and less than 100° may be preferred to facilitate maintaining the upper end 2*b* outside the storage housing 5 as filling begins, while effectively guiding the flow through the flexible pouch 2 to the lower end 2*a*.

The second portion 14*b* may run parallel to the inner face 8 which is flat (and typically vertical) when filling has not begun or has not sufficiently advanced to deform the second portion 14*b* significantly. Under these conditions, it is understood that angle A is the angle formed between the support surface 22 and the inner face 8 of panel 30, as can be inferred from FIGS. 3B and 4A. Although these figures show an angle of approximately 90°, it is understood that the lifting means T may be positioned differently, as the inclination defined by the support surface 22 can make this angle smaller (down to 60° for example) or larger (up to 130° for example).

The guide surface 60 has, for example, a continuous rounded C-shaped cross-section. It extends in a longitudinal direction parallel to the fastening element 21, just above this fastening element 21. The profile of the guide surface 60 may be the same along the length of the guide surface 60, this length corresponding to the distance between the lateral edges 23*b* and 23*c*, which here are parallel to one another. The curvature of this profile, with no significant reliefs or protruding angles, allows the flexible lines 9*a*, 9*b* to slide smoothly under the effect of deployment of the flexible pouch 2 at its lower end 2*a*. This rounded profile guides the change in orientation of the ports 12*a*, 12*b*, which transition from a downward orientation to an upward orientation. This change in orientation is illustrated by the sequence of FIGS. 5B, 5C, and 5D.

A half-pipe bend can be formed from end 23*a* of the slot 23 (or lower) to the opposite side which can define an intermediate portion of the inner edge 55 of the support surface 22, passing over the positioning member 28 of the fastening element 21. By way of non-limiting example, the guide surface 60 extends for a height H which is preferably at least equal to 2 cm, more preferably at least equal to 4 cm. It is therefore understood that this defines a bulge which defines a smooth transition between the lowest level of the guide surface 60 and the highest level. The portion of the guide surface 60 which defines end 23*a* of the slot 23 extends below the support surface 22 defined by the lifting means T in the deployed position. Thus, the supply lines 9*a*, 9*b* can engage the guide surface 60 well before the associated upper ports 12*a*, 12*b* are introduced into the storage housing 5.

Figure 8:
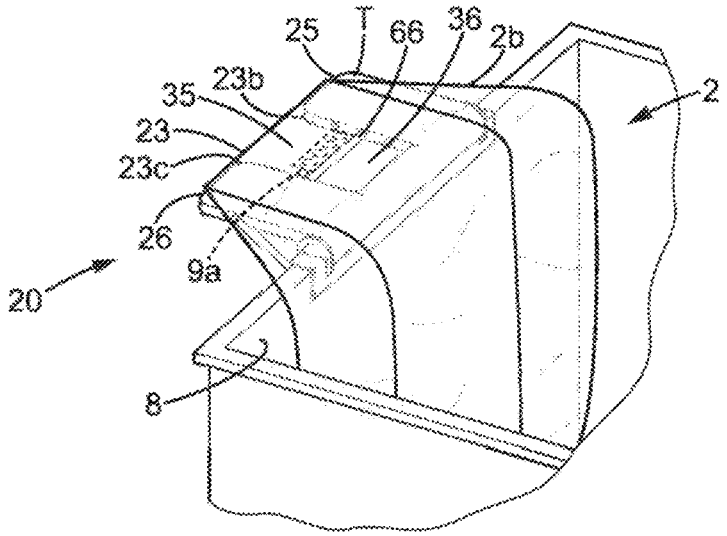
FIG. 8 shows a variant of the support device, with a spacer member extending transversely in the slot and initially keeping the flexible supply line or lines away from the rear end of the slot.

Referring to FIG. 8, an additional contact surface for contact with the flexible supply line 9*a* and possibly other adjacent flexible lines 9*b* is provided. Here, this additional surface is defined by a spacer member 66 which extends transversely to the slot 23 and extends from one to the other of the two shelves 25, 26. The spacer member 66 may be in the form of a roller that is optionally rotatable, a bar with a convex outer surface, a flat element with rounded ends, or other suitable shape, preferably extending parallel to the determined side 15. The spacer member 66 preferably has a greater rigidity than the constituent material of the flexible lines 9*a*, 9*b*, at least in the portion forming the additional contact surface. The spacer member 66 may extend across the slot 23 so as to define a front space 35 and a rear space 36 between the shelves 25 and 26. Alternatively, the spacer member 66 may extend below the level of the slot 23.

The flexible supply line 9*a* is thus initially held away from the guide surface 60, preferably extending outside the rear divider space 36 as shown in FIG. 8. It is understood that the spacer member 66 limits the insertion path of the flexible supply line 9*a* in the slot 23, and thus better maintains the upper end 2*b* of the flexible pouch 2 outside the storage housing 5. The spacer member 66 may be secured to one and/or the other of the shelves 25, 26. More generally, the spacer member 66 may be mounted on the lifting means T at the front of the guide surface 60, removably or fixedly, possibly with space.

Figure 9A:
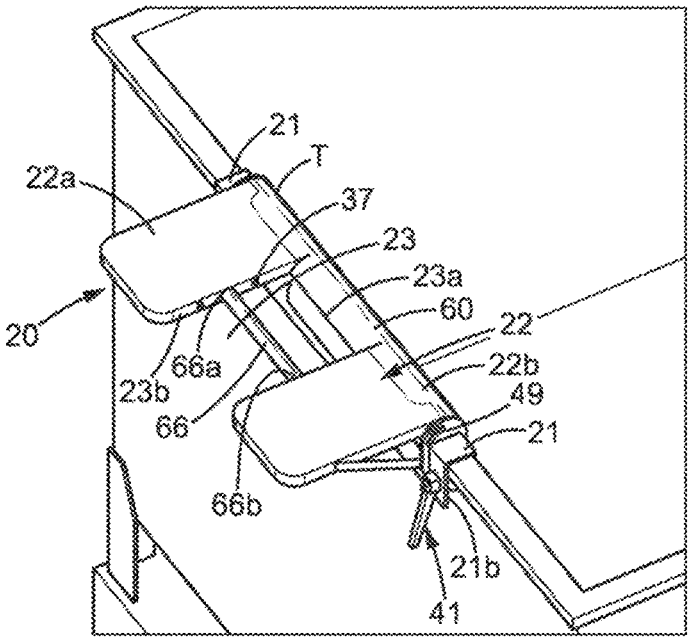
FIGS. 9A and 9B show two variants that allow adjusting the position of the spacer member.

Referring to FIG. 9A, the mounting position of the spacer member 66 may be selected from a plurality of positions that are more or less close to the rear end 23*a* of the slot 23. Predetermined anchoring elements 37 can thus be formed on the edges 23*b* and 23*c* defining the slot 23. Each of the ends 66*a* and 66*b* of the spacer member 66 is then held securely on the corresponding anchoring element 37. The anchoring elements 37 may be reliefs, in male and/or female form. Attachment can be achieved for example by engagement between recesses and elastically deformable protruding projections. Any other type of attachment can of course be used, for example a magnetic attachment or clamping attachment. In addition, the location of the attachment may vary, with an area of attachment in the slot 23, near the slot 23, or at a distance from the slot 23.

Figure 9B:
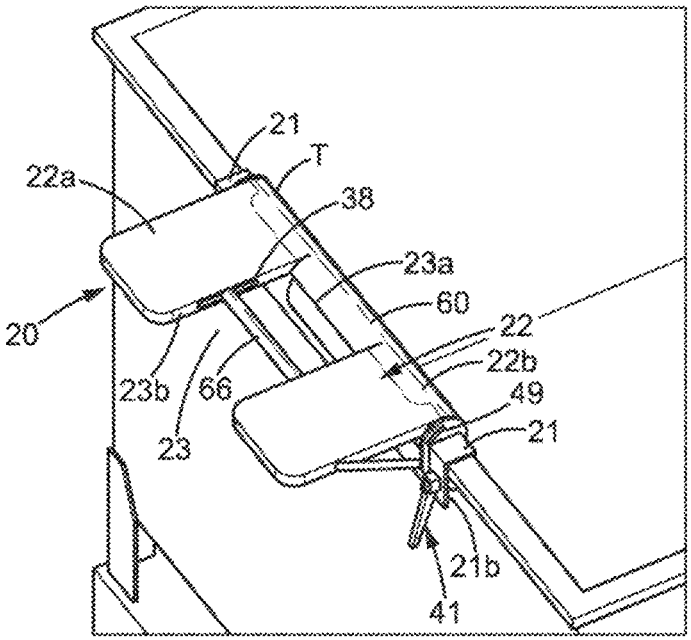

Referring to FIG. 9B, the mounting position of the spacer member 66 can be adjusted similarly to what is illustrated in FIG. 9A, but with the use of a pair of continuous grooves 38 that allow sliding the spacer member 66 in a direction perpendicular to the panel 30 in the mounted position of the support device 20. One can thus move the spacer member 66 easily and with more flexibility. The spacer member here traverses the slot 23, parallel to the determined side 15. Sliding with friction may be preferred to avoid using a specific device to prevent sliding. Alternatively, the spacer member 66 may be configured to engage and lock into place in at least one of the grooves, for example by actuating a quarter-turn rotation of the spacer member 66. More generally, any system for locking the spacer member 66 in position may be used.

Referring to FIG. 10, here the spacer member 66' is implemented as an assembly that can be fitted onto one or more ends at the front of the lifting means T. When the lifting means T comprise two shelves 25, 26, the spacer member 66' may have:

a first sheath 661 surrounding shelf 25;

a second sheath 662 surrounding shelf 26;

an intermediate portion 660 extending across the slot 23 or under the slot 23, and extending between the first sleeve 661 and second sleeve 662 to form the contact surface for the supply line or lines 9*a*, 9*b*.

Positional adjustment of the intermediate portion 660 is achieved by sliding each of the first and second sleeves 661, 662. Although the shelves 25, 26 and the sleeves 661, 662 here have an identical format with equal dimensions, it is understood that different general shapes and different dimensions may be used, in particular for the dimension in the direction perpendicular to the wall 30. The locking in position of the intermediate portion 660, functionally equivalent to the spacer member 66 of FIGS. 9A-9B, is achieved for example by the engagement of at least one clamping device 39, integral with sleeve 661 or 662, with a support surface of a corresponding shelf 25 or 26. This support surface, here formed by the outer edge 25*d* away from the slot 23, is preferably separate from the surface portions 22*a*, 22*b* that form the support surface 22.

More generally, it is understood that the distance d6 (see FIG. 10) between the front surface of spacer member 66 or 66' and the inner edge 55 of the lifting means T can be changed to adapt to the size of the flexible pouch 2.

Figure 11:
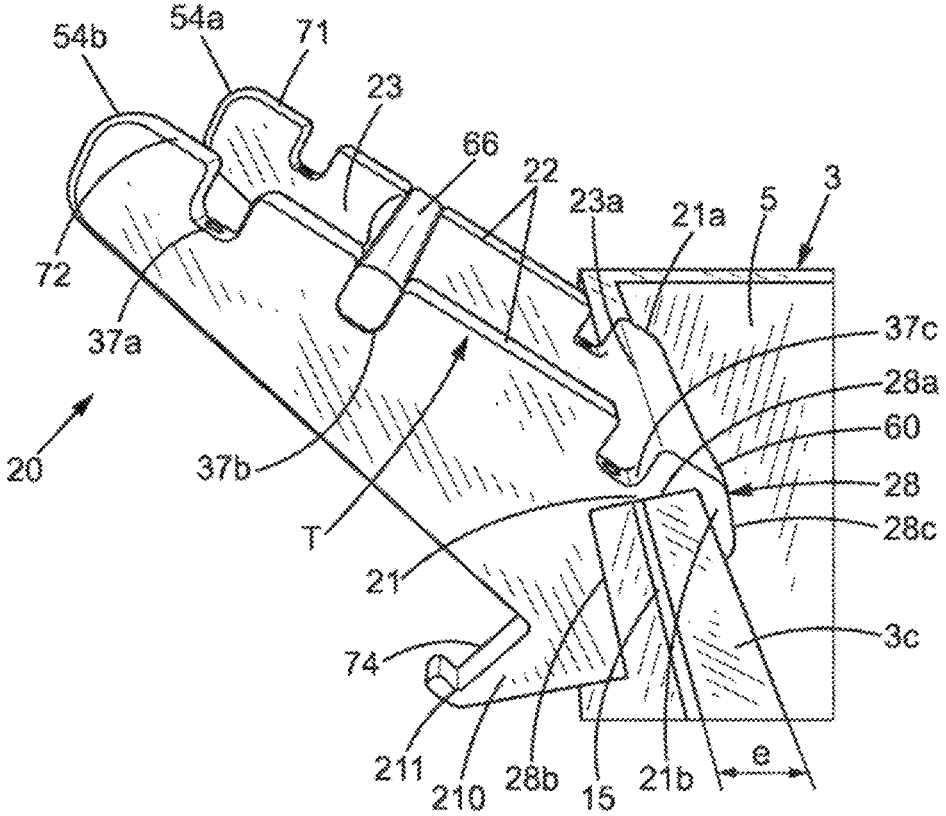
FIG. 11 shows a support device in a non-folding variant.

Referring to FIG. 11, a support device 20 is fixed on the determined side 15 of the upper edge 3*c*, here without clamping device, by screwing onto the container 3. In this example, the device 20 has a support surface 22, optionally formed by two uprights 71, 72, which is inclined in the deployed position. With such an inclination, it is understood that the position of the upper end 2*b* of the flexible pouch 2 is maintained outside the storage housing 5, and at a height level that is higher than the case illustrated in FIGS. 4A and 5A. In particular, angle A can be greater than 90°, preferably between 104° and 130°, with this configuration (ascending) of the support surface 22 in the deployed position which enables loading the flexible pouch 2.

The lifting means T, inclined to a position higher than the level of the upper edge 3*c*, move laterally away from the front wall 30 less than when the support surface 22 is substantially horizontal. With such an inclination, the forces exerted on the fastening element 21 due to the weight loaded on the support surface 22 can be reduced. The positioning member 28 of the fastening element 21 may have, for example, a U-shaped cross-section at least on the side of the two ends 21*a*, 21*b*. Arm 28*c* and arm 28*b*, which face one another, have a respective length much greater than thickness e, while the intermediate section 28*a* is almost as short as thickness e in order to minimize the clearance between the two arms 28*b*, 28*c* when the positioning member 28 is engaged on edge 3*c*.

In the example of FIG. 11, the support device 20 has an auxiliary fastening element 210 which may be adjacent to the fastening element 21 and which engages with the upper edge 3*c* of the container 3 in a manner comparable to the fastening element 21. The auxiliary fastening element 210 may have at least two hooks 211 or similar retaining members which here are formed on two opposite sides (near the ends 21*a*, 21*b*) of the support device 20, on either side of the rear end 23*a* of the slot 23. Each hook 211 may define a concave area of contact 74 with the upper edge 3*c* in a folded position that minimizes the size of the support device 20 around the container 3.

Thus, even if the support surface 22 is not movable relative to the fastening element 21 (no folding), it is still possible to move the support surface 22 between two positions:

a folded position, typically similar to the case illustrated in FIG. 6, with attachment of the support device 20 by the auxiliary fastening element 210, and a deployed position clearly visible in FIG. 11, with attachment onto the edge 3*c* by the fastening element 21.

Functionally, the support device 20 is thus completely comparable to the variants of FIGS. 9A-9B. In particular, we also find a spacer member 66 whose position can be adjusted due to the presence of predetermined anchoring elements 37*a*, 37*b*, 37*c*, here in the form of notches. The support device 20 may optionally have a part formed as one piece that defines the fastening element 21, the auxiliary fastening element 210, and the lifting means T (without the spacer member 66, or with it in an option with no adjustment of the spacer member 66).

A filling process with deployment of the 3D flexible pouch 2, using the support device 20 fastened on the upper edge 3*c* of the rigid container 3, will now be described by way of non-limiting example, with reference to FIGS. 2A-2C, 3, 4A-4B, and 5A-5D.

The flexible pouch 2, having its upper end 2*b* placed on the support surface 22, is connected to the pumping device 10 by at least one flexible supply line 9*a*, 9*b*. This connection is made externally to the storage housing 5, and the flexible supply line or lines 9*a*, 9*b* hang from the upper ports 12*a*, 12*b*, traversing the slot 23 in the vertical direction, as shown in FIGS. 3 and 4A. At this pre-filling stage, the flexible pouch 2 is flat as shown in FIGS. 2B and 3. The flexible line 7 connected to port 11 of the lower end 2*a* may be engaged in the through-hole 6*a*. In this case, the flexible pouch 2 can then have two fold lines before filling, respectively near the upper end and near the lower end of the front panel 30.

The support device 20 here is placed on the upper edge 3*c* so that the slot 23 is substantially equidistant from the two connecting panels 32 and 33, as shown in FIG. 3. This positioning helps minimize or even eliminate the filling problems caused by folds formed along the connecting panels 32, 33.

Each of the supply lines 9*a*, 9*b* is initially at a distance from the guide surface 60 when the upper end 2*b* of the flexible pouch 2 is placed on the support surface 2. The lower end 2*a* of the flexible pouch 2 is initially maintained in the half of the storage housing 5 located on the side of the inner face 8. The pouch 2 is thus kept away from the distal wall 31, opposite the inner face 8, so that the distal wall 31 does not prevent the lower end 2*a* from unfolding along an unfolding line Z parallel or substantially parallel to axis X. FIG. 3 shows a possible placement of the unfolding line Z. In practice, in the case of a flexible pouch 2 as shown in FIG. 2A, this unfolding line Z can typically coincide with the free edge 2*f* (a rectilinear edge here) of the pouch 2.

It can be seen in FIGS. 4A and 5B that the support device 20 maintains the upper end 2*b* outside the storage housing 5 during a filling phase which corresponds to the beginning of unfolding of the bottom wall W1. This maintaining of the upper end 2*b* is advantageous as it allows gradual expansion of the bottom wall W1. A gradual and smooth (even) deployment avoids any incorrect positioning of the bottom wall W1, which should cover all or almost all of the bottom 3*a* when the flexible pouch 2 is in a filled state as shown in FIG. 2C.

Figure 4B:
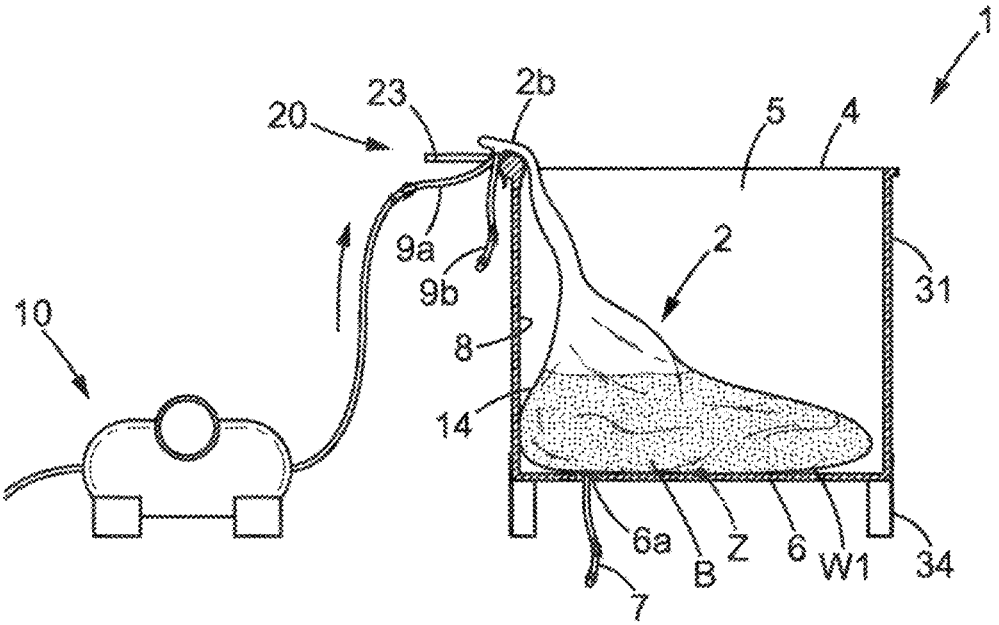

FIGS. 4A and 4B schematically represent the unfolding which takes place during filling, at the bottom wall W1 around the unfolding line Z. Such unfolding occurs for example when the filling reaches between 5 and 30% of the capacity of the flexible pouch 2, typically around 10%.

FIG. 5B shows a filling state of the flexible pouch 2 which precedes an unfolding to more than 90° around the unfolding line Z. One can see that the upper port or ports 12*a*, 12*b* can be moved along the slot 23, at least at the beginning of filling. Then the flexible pouch 2 reaches a filling state in which the unfolding around the unfolding line Z (here coinciding with the position of edge 2*f*) is at about 180°, as shown FIG. 4B and FIG. 5C in particular. The unfolding angle corresponds to 180° in the case of a bottom 3*a* that is substantially planar, and it is more generally understood that the unfolding occurs in a manner that is adapted to the surface of the bottom 3*a*.

At least during the beginning of filling, the slot 23 separating the support surface 22 into two surface portions 22*a*, 22*b* guides the advancement of the upper end 2*b* toward the upper opening 4. Due to this guidance, a major portion of the flexible pouch 2 is still kept close to the inner face 8 and no retention area for biopharmaceutical product B is created at a distance from the bottom wall W1. The height level of the ports 12*a*, 12*b* here is at least equal to the height level of the upper edge 3*c*, which facilitates the flow of biopharmaceutical product B in the direction of the storage housing 5, towards the lower end 2*a*. The filling fluid flows freely into the pouch (without impediment).

When the bottom wall W1 is sufficiently unfolded, as shown in FIGS. 4A and 5C, each supply line 9*a*, 9*b*, guided between the lateral edges 23*b* and 23*c* defining the slot 23, can engage with the guide surface 60. The curvature of the convex guide surface 60, which preferably descends lower than the height level of the support surface 22, eliminates the risk of a supply line 9*a*, 9*b* catching on a wall of the rigid container 3. The rounded profile of the guide surface 60, with no projecting angles or significant edges, prevents the flexible supply lines 9*a*, 9*b* from catching. The guide surface 60 here extends radially for a distance which may be greater than the thickness e of the determined side 15 of the upper edge 3*c*. It is therefore understood that these supply lines 9*a*, 9*b* cannot be bent to an angle less than or equal to 90° around the guide surface 60.

The upper end 2*b* can enter the storage housing 5 completely, due to the reduction in height of the flexible pouch 2 during filling (as can be seen by comparing FIGS. 2A and 2C). The upper end 2*b* is still substantially flat, as shown in FIG. 5C. It is understood that the unfolding at the top wall W2 (along edge 2*e*) is delayed and can begin after the unfolding that occurs at the bottom wall W1 (unfolding along edge 2*f*, under the effect of the accumulation of biopharmaceutical fluid B in the lower portion of the storage housing 5). One advantage of the method is that the displacement of the upper end 2*b* occurs passively, under the effect of this accumulation which increases the mass and volume of the assembly formed by the flexible pouch 2 and the biopharmaceutical product B that it contains.

When a spacer member 66 or 66' is used, as shown in FIGS. 8, 9A-9B, and 10, the flexible supply line or lines 9*a*, 9*b* come into position through the front space 35 and abut against the spacer member 66 or 66'. This position of the flexible supply lines 9*a*, 9*b* also encourages the delaying of the unfolding at the top wall W2. The position of the front surface of the spacer member 66 or 66' (more or less distant from the inner edge 55) can be adjusted according to the size of the flexible pouch 2, by moving the attachment or clamping area of the spacer member 66 or 66' relative to the lifting means T.

The flexible pouch 2 can thus move gradually and continuously, without impediment. Optimal filling is obtained to a filling state greater than or equal to 50%, as shown in FIG. 5D. No human intervention is required to reposition the flexible pouch 2, in particular at the time of deployment of the bottom wall W1 around the fold line Z.

It is understood that guiding the fluid is simple when filling begins, since there is no fold aside from the gradual fold line formed by rolling the upper end 2*b* around the convex guide surface 60 bordering the upper opening 4. Then, as shown in FIGS. 4A and 5C, the supply lines 9*a*, 9*b* also roll over the convex guide surface 60 and thus gradually travel over the upper end 2*b* without catching. The volume of biopharmaceutical fluid B in the flexible pouch 2 is then already large enough and the bottom wall W1 has unfolded enough to prevent twisting or the formation of significant wrinkles in the flexible pouch 2. Moreover, the guidance provided by the slot 23 ensures that the upper ports 12*a*, 12*b* remain positioned closer to the front panel 30 than to any of the other panels 31, 32, 33 of the side wall 3*b*.

Once the flexible pouch 2 is correctly deployed with its content of biopharmaceutical fluid B (filling has ended), the support device 20 can be placed in the folded position, to facilitate access to inside the container 3 and to the disposable flexible pouch 2. The folded position does not obstruct the operator and reduces the overall dimensions.

The invention claimed is:

1. A method for loading a 3D flexible pouch in a storage housing of a rigid container, wherein:

the rigid container has a predetermined depth, wherein the flexible pouch is adapted for filling with a biopharmaceutical product via at least one flexible supply line, the container comprising an upper edge defining an upper transverse opening for access to the storage housing, the method comprising, prior to filling, the steps of:

extending the flexible pouch, in an initial non-filled state, along a given inner face of the storage housing, so as to define a lower end and an upper end which are arranged on either side of said upper transverse opening, wherein the upper end of the flexible pouch comprises at least one upper port to which said flexible supply line is connected, said upper port being arranged on a given face of the flexible pouch in the initial non-filled state;

maintaining the upper end outside of the storage housing;

the method further comprising the following steps:

providing a support surface on the rigid container, via at least one support device mounted along a determined side of the upper edge, orientating and positioning the flexible pouch so that a first portion of the given face of the flexible pouch is face to face with the given inner face and so that a second portion of said given face of the flexible pouch is in contact with the support surface, such that said flexible supply line connects to the flexible pouch from underneath the support surface, and before or during filling, inserting said flexible supply line through a slot that separates said support surface into two surface portions, while keeping the second portion of the given face, which is part of the upper end of the flexible pouch, placed against the support surface, during filling, guiding said supply line by a convex guide surface provided in the support device and extending between the two surface portions, the guide surface covering a portion of the upper edge of the rigid container and delimiting one end of the slot, whereby the supply line can be lifted above the upper edge during filling, when the upper end of the flexible pouch is moved into the storage housing, wherein the upper end of the flexible pouch extends parallel to the support surface which is substantially planar, prior to filling, and wherein the lower end of the flexible pouch is initially maintained at a distance from a distal wall of the container opposite to the given inner face of the container, the unfolding of the flexible pouch along the bottom wall of the storage housing allowing, as the flexible pouch is filled, a pulling of the upper end of the flexible pouch inwardly into the storage housing, so that said flexible supply line engages with and moves against the guide surface.

2. The method according to claim 1, wherein the support surface is placed on the rigid container so as to extend transversely and laterally outwards relative to the given inner face of the storage housing, whereby the upper end of the flexible pouch is in a laterally offset position relative to the storage housing when the upper end is resting on the support surface.

3. The method according to claim 1, comprising, before filling, the step of:

connecting another flexible line to a lower port located in the lower end of the flexible pouch, and inserting this other flexible line into a through-hole to pass through a bottom wall of the storage housing.

4. The method according to claim 1, comprising the steps of:

filling the flexible pouch using at least one flexible supply line and a corresponding number of upper ports provided in the upper end of the flexible pouch, on the given face; and during filling, guiding the at least one flexible supply line by the convex guide surface.

5. The method according to claim 1, wherein a first shelf is provided for forming all or part of one of the two surface portions of the support surface, wherein a second shelf is provided for defining all or part of the other of the two surface portions of the support surface, and wherein the first shelf and the second shelf are coplanar and each have a lateral edge forming a side of the slot, two flexible supply lines being inserted through the slot which extends between the first shelf and the second shelf.

6. The method according to claim 1, wherein the flexible pouch has a capacity of between 100 and 1000 L, the storage housing of the rigid container containing the entire contents of the flexible pouch in a filled state.

7. The method according to claim 1, wherein the support device is removably attached on the determined side of the upper edge, by clasping.

8. The method according to claim 1, wherein the upper end of the flexible pouch is placed at a height level greater than or equal to a height level of the determined side of the upper edge, when it is resting on the support surface.

9. The method according to claim 1, wherein an angle formed between said first portion and said second portion is between 60° and 130° prior to filling.

10. The method according to claim 1, wherein the second portion of said given face is part of the upper end of the flexible pouch, the upper end of the flexible pouch being moved to inside the storage housing in a passive manner due to increase in mass and volume of assembly formed by the flexible pouch and the biopharmaceutical product contained in the flexible pouch.

11. The method according to claim 1, wherein the support surface is moved from a folded position to a deployed position that enables the support surface to support the upper end of the flexible pouch at a height level that is higher than the upper edge.

12. The method according to claim 11, wherein the deployed position is locked by the contact of at least one pin that is integral in rotation with the support surface, against a stop of the support device which is integral to a fastening element attached to the rigid container.

13. The method according to claim 1, wherein the two surface portions, which are separate from the rigid container and included in the support device, are formed entirely above the rigid container, and wherein a part of the support device forming the convex guide surface separates the slot from the upper transverse opening.

* * * * *